US009357806B2

(12) United States Patent
Terrell

(10) Patent No.: US 9,357,806 B2
(45) Date of Patent: Jun. 7, 2016

(54) MEDICAL EXAMINATION GOWN

(71) Applicant: Encompass Group, LLC, McDonough, GA (US)

(72) Inventor: Kelley Terrell, Ferris, TX (US)

(73) Assignee: Encompass Group, LLC, McDonough, GA (US)

( * ) Notice: Subject to any disclaimer, the term of this patent is extended or adjusted under 35 U.S.C. 154(b) by 297 days.

(21) Appl. No.: 14/094,986

(22) Filed: Dec. 3, 2013

(65) Prior Publication Data

US 2015/0150317 A1 Jun. 4, 2015

(51) Int. Cl.
*A41D 13/12* (2006.01)

(52) U.S. Cl.
CPC ..... *A41D 13/1245* (2013.01); *A41D 13/129* (2013.01)

(58) Field of Classification Search
CPC ..... A41D 13/00
USPC ..... 2/114, 51, 113, 69
See application file for complete search history.

(56) References Cited

U.S. PATENT DOCUMENTS

| | | | | | |
|---|---|---|---|---|---|
| 715,248 | A * | 12/1902 | Davis | A41D 11/00 | 2/211 |
| 818,351 | A * | 4/1906 | Clark | A41D 13/1236 | 2/114 |
| 1,122,737 | A * | 12/1914 | Guinan | A41D 1/14 | 2/211 |
| 2,148,344 | A * | 2/1939 | Freedman | A41D 1/22 | 2/70 |
| 2,849,716 | A * | 9/1958 | Kerson | A41D 15/00 | 2/70 |
| 3,557,385 | A | 1/1971 | Hendrickson | | |
| 3,803,640 | A | 4/1974 | Ericson | | |
| 5,062,159 | A * | 11/1991 | Jakub | A41D 13/1236 | 2/105 |
| 5,727,255 | A | 3/1998 | Minks | | |
| 5,802,611 | A * | 9/1998 | McKenzie | A41D 13/1236 | 2/114 |
| 6,374,415 | B1 | 4/2002 | Lenart | | |
| 6,460,188 | B1 * | 10/2002 | Hatton | A41D 13/1245 | 2/114 |
| 6,799,332 | B2 | 10/2004 | Hatton | | |
| 7,260,852 | B2 * | 8/2007 | Sheetz | A41D 7/00 | 2/104 |
| 7,424,750 | B2 | 9/2008 | Kerr | | |
| 7,694,350 | B2 | 4/2010 | Hodges et al. | | |
| 7,865,972 | B2 | 1/2011 | Simon | | |
| 2008/0271222 | A1 | 11/2008 | Nienow | | |
| 2012/0305541 | A1 * | 12/2012 | Giles | 219/211 | |
| 2013/0133125 | A1 | 5/2013 | Mungaray | | |

* cited by examiner

*Primary Examiner* — Gloria Hale
(74) *Attorney, Agent, or Firm* — Baker Donelson; Dorian Kennedy

(57) ABSTRACT

An examination gown (10) has a front side (11) of a metalized fabric material and a back side (12) made of a material which includes small fibers. The back side has a back seam which includes a top side (24) and a bottom side which are releasably joined together. The seam top side includes a pair of high strength loop type fasteners (31) spaced apart to allow the exposure of the interior surface of the seam top side therebetween which forms a low strength loop type fasteners. The back seam bottom side (25) includes a strip of hook type fasteners (36). The mating of the high strength loop type fasteners with the hook type fasteners provides a high degree of separation resistance compared to that of the low strength loop type fasteners. The front side has a laterally extending front seam (41) similar in construction to the back seam.

11 Claims, 2 Drawing Sheets

MEDICAL EXAMINATION GOWN

TECHNICAL FIELD

This invention relates generally to medical examination gowns and more specifically to medical examination gowns which are adapted to be reconfigurable.

BACKGROUND OF THE INVENTION

Heretofore, medical gowns have been designed to allow access to the body of a patient undergoing an examination or medical procedure. These gowns are oftentimes designed to have releasable panels or openings to allow medical personnel access to an underlying body part. While these types of examination gowns allow limited access, they do not provide access to a large area of the patient's body while allowing the patient to remain substantially covered. This problem may result in undue exposure of the patient and the loss of body heat during the examination or medical procedure, thereby causing the patient embarrassment as well as discomfort and the possibilities of a hypothermic reaction. Accordingly, it is seen that a need remains for a medical examination gown that provides access to a patient's body yet maintains a high level of body coverage. It is to the provision of such therefore that the present invention is primarily directed.

SUMMARY OF THE INVENTION

In a preferred form of the invention a medical examination gown comprises a front side having a top portion and a bottom portion separate from the top portion, a back side having a top portion and a bottom portion separate from the top portion. The back side top portion is divided to form a top portion right portion and a top portion left portion. The back side bottom portion is divided to form a bottom portion right portion and a bottom portion left portion. The medical examination gown also has a fastener releasably joining the top portion right portion to the top portion left portion and a front seam releasably joining at least a portion of the front side top portion to a portion of the front side bottom portion. The medical examination gown also has a back seam releasably joining the back side top portion right portion to the back side bottom portion right portion and releasably joining the back side top portion left portion to the back side bottom portion left portion. The back seam co-extends from either side of the front seam. The back seam includes at least two high strength loop type fasteners spaced apart from each other and a low strength loop type fastener positioned between the two high strength loop type fasteners. The back seam also includes hook type fasteners configured to releasable mate with the high strength loop type fasteners and the low strength loop type fastener.

DETAILED DESCRIPTION

Figure 2:
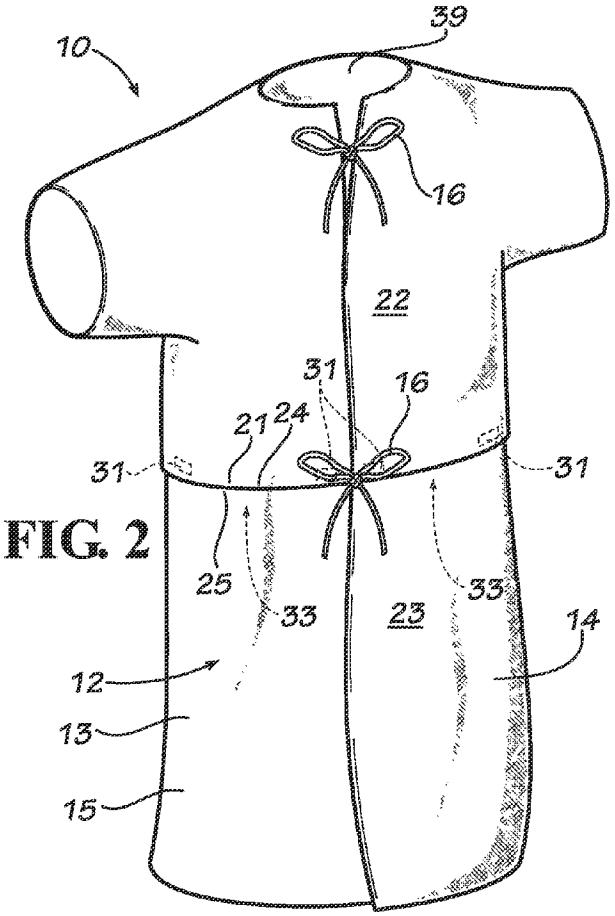
FIG. 2 is a perspective, rear view of the medical examination gown of FIG. 1.
Figure 1:
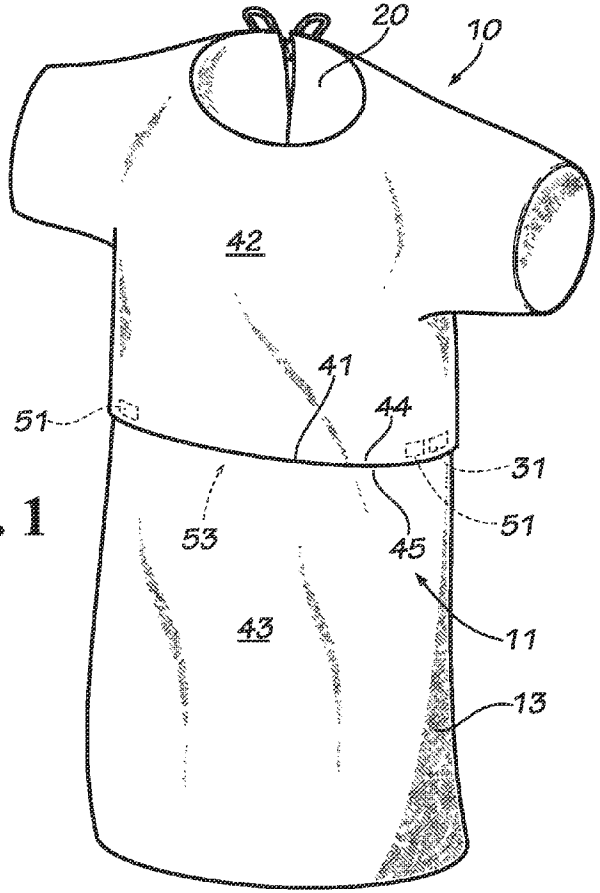
FIG. 1 is a perspective, front view of a medical examination gown embodying principles of the invention in a preferred form.

With reference next to the drawings, there is shown a medical examination gown 10 in a preferred form of the invention. The gown 10 has a front side or portion 11 joined to a back side or portion 12 which in combination forms a body covering 13 which covers at least the torso of a patient. The back side 12 is longitudinally divided into a right side 14 and a left side 15, each of which includes ties 16, or other types of conventional fasteners such as snaps, button, releasable adhesive, hook and loop type fasteners, which when tied together secure or seam the two sides (14 and 15) together.

The gown back side 12 is made of a lofted billow spunbond thermoplastic (for example, a polypropylene) non-woven material which includes extremely small fibers or fiber loops within the material. If the garment back side 12 is made of a multilayer material, the interior surface 20, or at least a portion of it, is preferably made of a lofted billow spunbond thermoplastic non-woven material.

The back side 12 has a laterally extending back seam 21 positioned below the sleeves which divides the back side between a back side top portion 22 and a back side bottom portion 23. The back seam 21 includes a back seam top side or portion 24 and a back seam bottom side or portion 25 which are releasably joined together. The back seam top side 24, associated with the gown back side top portion 22, includes a pair of outer high strength loop type fasteners 31 (high bonding strength) spaced apart from each other at opposite ends of the back seam top side 24. The space or spacing 33 between the high strength loop type fasteners 31 allows the exposure of the interior surface of the gown back seam top side 24 therebetween. The spacing 33 or exposure of the small loops of the back side interior surface 20 at spacing 33 may be considered an area of low strength loop type fasteners (low bonding strength) because of the material composition of small loops or threads therein. The back seam bottom side 25, associated with the gown back side bottom portion 23, includes an elongated strip of very small hook type fasteners 36 along substantially the entire length of the back seam bottom side 25. The mating of the high strength loop type fasteners 31 with the hook type fasteners 36 provides a high degree of separation resistance compared to that between the low strength loop type fasteners and the hook type fasteners 36.

The gown front side 11 is preferably made of a heat reflective, metalized material, such as that sold by Encompass Group, LLC of McDonough, Ga. under the tradename THERMOFLECT. The metalized material has an interior facing layer or surface 39 which is a lofted billow spunbond thermoplastic non-woven material having extremely small fibers or fiber loops within the material.

The front side 11 has laterally extending front seam 41 positioned below the sleeves which divides the front side between a front side top portion 42 and a front side bottom portion 43. The front seam 41 includes a front seam top side or portion 44 and a front seam bottom side or portion 45 which are releasably joined together and extend from the back side corresponding portions 24 and 25, i.e., front and back seams 41 and 21 form a single seam which co-extends circumferentially about the gown. The front seam top side 44, associated with the gown front side top portion 42, includes a pair of outer high strength loop type fasteners 51 (high bonding strength) spaced apart from each other at opposite ends of the front seam top side 44. The space or spacing 53 between the high strength loop type fasteners 51 allows the exposure of the interior surface 39 of the gown front seam top side 44 therebetween. The spacing 53 or exposure of the small loops of the front side interior surface 39 at space 53 may be considered an area of low strength loop type fasteners (low bonding strength) because of the material composition of small loops or threads therein. The front seam bottom side 45, associated with the gown front side bottom portion 43, includes an elongated strip of very small hook type fasteners 56 along substantially the entire length of the front seam top side 44. The mating of the high strength loop type fasteners 51 with the hook type fasteners 56 provides a high degree of separation resistance compared to that between the low strength loop type fasteners and the hook type fasteners 56.

The mating of the high strength loop type fasteners 51 with the hook type fasteners 56 provides a high degree of separation resistance compared to that between the low strength loop type fasteners and the hook type fasteners 56. As an alternative, the gown may incorporate a single high strength loop type fastener near the juncture of the front and back sides rather than having a high strength loop type fastener associated with both the front and back seams.

In use, a patient dons the gown 10 in a customary manner. The patient may then walk about, sit or lay down with the examination gown covering the patient for both modesty and warmth.

Figure 3:
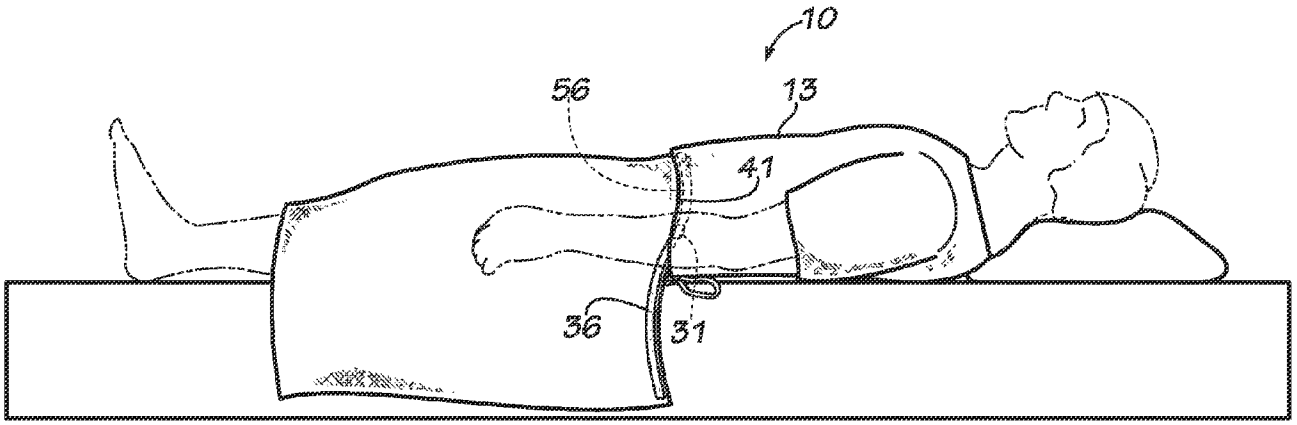
FIG. 3 is a side view of a patient wearing the medical examination gown of FIG. 1 in a partially open configuration.

Should an examination or medical procedure be conducted upon the patient, the back seam 21 may be disjoined, as shown in FIG. 3, to allow access to the lower body portion of the patient. However, even with the back seam 21 disjoined the gown still covers the patient to maintain modesty and warmth. Here, the gown (lower portion) still acts as a covering, generally in the form similar to a blanket which allows access to the body by simply lifting the (lower portion).

Figure 4:
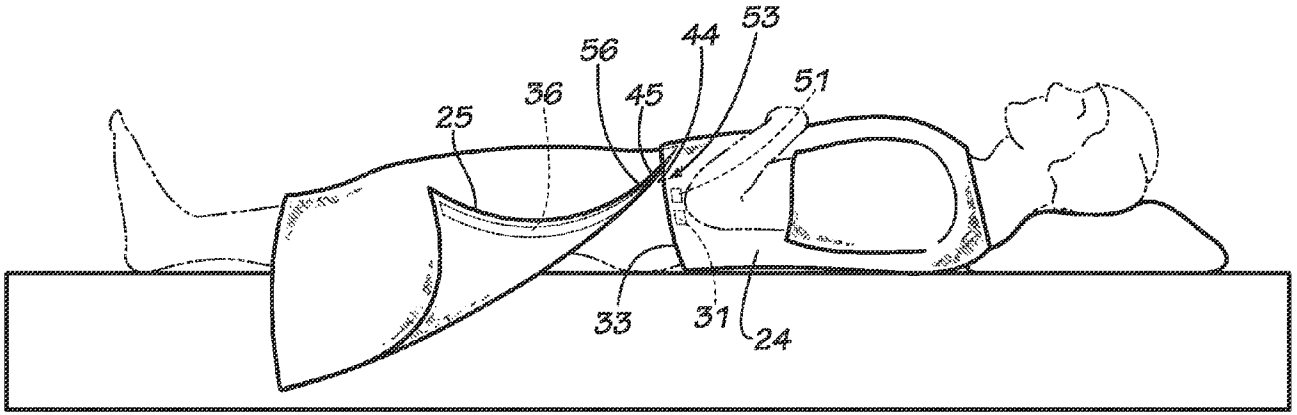
FIG. 4 is a side view of a patient wearing the medical examination gown of FIG. 1 in another partially open configuration.

Should the examination or medical procedure require the exposure of more of the patient's anterior region, the separation of the back seam 21 continues to the separation of the front seam 41, as shown in FIG. 4. Here again, the gown still covers the vast majority of the patient to maintain modesty and warmth.

Once the examination or medical procedure has concluded, the seam or seams may be rejoined through the coupling of the fasteners.

The ends of the back seam 21 being fitted with the high strength fasteners allows the seam to remain securely fastened as the patient moves about. However, once the high strength fasteners are manually released the remaining portion of the seam coupled with the low strength fasteners may be more easily separated to enable ease of separation without substantial effort or pulling upon the gown in order to do so.

As used herein, the term low strength loop type fastener or the like is intended to define that which can easily be unfastened from the hook type fasteners or provides a weak bond therebetween, so that the coupling may be manually unfastened. The term high strength loop type fasteners or the like is intended to define a more stable joining of the portions in order to secure them together to prevent the unwanted separation therebetween should the patient turn, walk, sit-up, or otherwise move in a normal fashion.

It should be understood that the term strip used herein may include a continuous strip of material as well as a series of segments, which may or may not include small spaces between adjacent segments.

It should be understood that the relative positions of the loop and hook type fasteners can be reversed. Also, rather than having the gown material itself provide the low strength loop type fasteners, an additional strip or length of low strength loop type fasteners may be coupled to the gown opposite the hook type fasteners 23. This alternative would allow the gown to be made of material other than that of the preferred embodiment which includes loops or threads which mater with the fastener hooks.

It should be understood that by making the gown with the front side made of a metalized fabric material the body heat generated by the patient is reflected back to the patient to keep a steady body temperature. Furthermore, by making the gown with the back side made of a non-metalized fabric material the back of the patient does not become overheated as the patient lies of his or her back for an extended period of time.

It thus is seen that a medical examination gown is now provided that provides greater access to the patient's body while remaining coverage over the body. Although the medical examination gown has been illustrated and described in its preferred form, it should be understood that many modifications, additions and deletions may be made to that specific form without departure from the spirit and scope of the invention as set forth in the following claims.

The invention claimed is:

1. A medical gown comprising:

a front side having a top portion and a bottom portion releasably coupled to said top portion;

a back side having a top portion and a bottom portion completely releasably coupled to said top portion, said back side top portion being separately divided to form a top portion right portion and a top portion left portion, said back side bottom portion being divided to form a bottom portion right portion and a bottom portion left portion;

a fastener releasably joining said top portion right portion of said back side to said top portion left portion of said back side;

a front seam releasably joining at least a portion of said front side top portion to a portion of said front side bottom portion, and a back seam releasably joining said back side top portion right portion to said back side bottom portion right portion and releasably joining said back side top portion left portion to said back side bottom portion left portion, said back seam co-extending from either side of said front seam, said back seam includes at least two first strength loop type fasteners spaced apart from each other and a second strength loop type fastener positioned between said two first strength loop type fasteners, said back seam also includes hook type fasteners configured to releasable mate with said first strength loop type fasteners and said second strength loop type fastener, said first strength loop type fasteners having a holding strength greater than said second strength loop type fasteners.

2. The medical gown of claim 1 wherein at least a portion of said front side is made of a metalized fabric material.

3. The medical gown of claim 2 wherein said back side is made of a non-metalized fabric material.

4. The medical gown of claim 1 wherein said second strength loop type fasteners are formed by the material from which said back side is made.

5. A medical gown comprising a body covering configured to cover the torso of a patient, said covering having a longitudinally extending seam and a laterally extending circumferential seam dividing the gown into a top portion and a bottom portion releasably coupled to said top portion along said circumferential seam, said circumferential seam having at least two first strength loop type fasteners each mounted to one end of said circumferential seam and at least one area of second strength loop type fasteners positioned generally between said two first strength loop type fasteners, said circumferential seam also including a strip of hook type fasteners adapted to mate with said first strength loop type fasteners and said second strength loop type fasteners, said first strength loop type fasteners having a holding strength greater than said second strength loop type fasteners.

6. The medical gown of claim 5 wherein said body covering has a front side configured to cover the anterior region of a patient and wherein at least a portion of said front side is made of a metalized fabric material.

7. The medical gown of claim 2 wherein said body covering has a back side configured to cover the posterior region of a patient and wherein said back side is made of a non-metalized fabric material.

8. The medical gown of claim 1 wherein said second strength loop type fasteners are formed by at least a portion of the material from which said body covering is made.

9. A medical gown comprising:

a front side having a top portion and a bottom portion separate from said top portion, at least a portion of said front side being made of a metalized fabric material;

a back side having a top portion and a bottom portion completely separable from said top portion, said back side being made of a non-metalized fabric material, said back side top portion being divided to form a top portion right portion and a top portion left portion separable from said top portion right portion, said back side bottom portion being divided to form a bottom portion right portion and a bottom portion left portion;

a fastener releasably joining said back side top portion right portion to said back side top portion left portion;

a front seam releasably joining at least a portion of said front side top portion to a portion of said front side bottom portion, and a back seam releasably joining said back side top portion right portion to said back side bottom portion right portion and releasably joining said back side top portion left portion to said back side bottom portion left portion, said back seam co-extending from either side of said front seam.

10. The medical gown of claim 9 wherein said back seam includes at least two first strength loop type fasteners spaced apart from each other and a second strength loop type fastener positioned between said two first strength loop type fasteners, said back seam also includes hook type fasteners configured to releasable mate with said first strength loop type fasteners and said second strength loop type fastener, said first strength loop type fasteners having a holding strength greater than said second strength loop type fasteners.

11. The medical gown of claim 10 wherein said second strength loop type fasteners are formed by the material from which said back side is made.

* * * * *